US005484017A

United States Patent [19]

Coon

[11] Patent Number: 5,484,017

[45] Date of Patent: Jan. 16, 1996

[54] WHIPSTOCK ASSEMBLY FOR A SLEEVED CASING

[75] Inventor: Robert J. Coon, Houston, Tex.

[73] Assignee: Baker Hughes Incorporated, Houston, Tex.

[21] Appl. No.: 371,868

[22] Filed: Jan. 12, 1995

[51] Int. Cl.[6] ..... E21B 7/08; E21B 23/00; E21B 34/14

[52] U.S. Cl. ..... 166/117.5; 166/382; 175/79

[58] Field of Search ..... 166/117.5, 117.6, 166/382, 381; 175/78, 79, 81, 82, 83, 61

[56] References Cited

U.S. PATENT DOCUMENTS

| | | | |
|---|---|---|---|
| 2,506,799 | 5/1950 | Livingston . | |
| 2,978,032 | 4/1961 | Hanna | 166/117.5 |
| 3,215,204 | 11/1965 | Sims | 166/117.5 |
| 3,397,746 | 8/1968 | Link | 166/117.6 |
| 4,397,360 | 8/1983 | Schmidt | 175/61 |
| 4,432,416 | 2/1984 | Welch et al. | 166/117.5 |
| 4,640,353 | 2/1987 | Schuh | 175/81 X |
| 4,726,421 | 2/1988 | Akkerman et al. | 166/117.5 |
| 4,807,704 | 2/1989 | Hsu et al. | 166/313 |
| 4,880,059 | 11/1989 | Brandell et al. | 166/332 |
| 4,928,767 | 5/1990 | Jelsma | 166/117.6 X |
| 4,991,654 | 2/1991 | Brandell et al. | 166/332 |
| 5,090,481 | 2/1992 | Pleasants et al. | 166/373 |
| 5,115,872 | 5/1992 | Brunet et al. | 175/61 |
| 5,154,231 | 10/1992 | Bailey et al. | 166/298 |
| 5,156,220 | 10/1992 | Forehand et al. | 166/386 |
| 5,335,737 | 8/1994 | Baugh | 175/61 |
| 5,341,873 | 8/1994 | Carter et al. | 166/117.5 |

*Primary Examiner*—Stephen J. Novosad
*Attorney, Agent, or Firm*—Rosenblatt & Redano

[57] ABSTRACT

A casing is provided with a sealable shifting sleeve. A whipstock is insertable into the casing and may be supported off of the casing in a predetermined location so that it is oriented toward an open window in the casing when the shifting sleeve is selectively moved upwardly. By presenting an open window for the whipstock oriented toward the window, a drillbit may be lowered through the casing to interact with the whipstock to immediately begin the drilling of the deviated wellbore. The drillbit cuts through any cement, if present, and into the formation. A bore is presented in the whipstock to allow production from pay zones below the whipstock while it is in place. Should it become necessary, the sliding sleeve may be subsequently closed to isolate the deviated wellbore which has been drilled with the whipstock through the open window.

26 Claims, 15 Drawing Sheets

WHIPSTOCK ASSEMBLY FOR A SLEEVED CASING

FIELD OF THE INVENTION

The field of this invention relates to whipstocks, particularly those that may be supported by a casing, and more particularly those that can be used in combination with a sleeve in the casing.

BACKGROUND OF THE INVENTION

Whipstocks have long been used to divert a milling tool to cut a new opening through a casing. Typically in these installations, a packer is set in the casing which has a lug or some other guide mechanism to orient the whipstock. The plug or packer is set in the casing and then the whipstock is secured to the packer in the appropriate orientation for the new deviated path to be milled and ultimately drilled. A milling tool is then used to cut through the casing. Having cut through the casing, the milling tool is removed to the surface and drilling with the appropriate bit commences.

Various designs of whipstocks and mounting systems therefor are illustrated in U.S. Pat. Nos. 2,506,799; 5,154,231; 3,397,746; 5,335,737; 5,341,873; and 5,115,872.

U.S. Pat. Nos. 5,156,220; 5,090,481; 4,991,654; and 4,880,059 illustrate the use of sliding sleeves which can be selectively opened to exposed perforations in a casing, which can then permit flow into the casing. The Brandel U.S. Pat. No. 4,991,654 illustrates the use of disintegratable plugs in the openings. U.S. Pat. Nos. 4,397,360 and 4,807,704 illustrate the use of whipstocks to create lateral wellbores from the main wellbore.

It should be noted that some casings, particularly in deviated wellbores, may not be cemented. Casing packers mounted externally to a section or sections of casing can be used to isolate the casing from the wellbore.

The drawback of the current designs is that a separate mill must be employed to cut through the casing, which must then be retracted to the surface so that a drillbit can be mounted to allow the drilling to continue into the formation. The apparatus of the present invention seeks to eliminate the milling step by providing a casing with a sleeve shiftable between an open and closed position to selectively open a window in the casing. The window may be closed during the cementing operation and may be subsequently opened for forming the deviated wellbore off of the whipstock. Should it be desired, the sleeve can, anytime after the drilling of the deviated wellbore and production therefrom, be fully closed. The whipstocks that can be employed with this system can be mounted from the casing directly and can also feature a bore therethrough to allow production from pay zones below the whipstock.

SUMMARY OF THE INVENTION

A casing is provided with a sealable shifting sleeve. A whipstock is insertable into the casing and may be supported off of the casing in a predetermined location so that it is oriented toward an open window in the casing when the shifting sleeve is selectively moved upwardly. By presenting an open window for the whipstock oriented toward the window, a drillbit may be lowered through the casing to interact with the whipstock to immediately begin the drilling of the deviated wellbore. The drillbit cuts through any cement, if present, and into the formation. A bore is presented in the whipstock to allow production from pay zones below the whipstock while it is in place. Should it become necessary, the sliding sleeve may be subsequently closed to isolate the deviated wellbore which has been drilled with the whipstock through the open window.

DETAILED DESCRIPTION OF THE PREFERRED EMBODIMENT

The body 10 is illustrated in FIGS. 1A–D. A sleeve 12 is shown in the closed position over a window 14. The window 14 is premade in the body 10 and can extend as much as approximately 140° circumferentially. It should be noted that the window 14 is not produced by a milling tool but is provided in a specially formed segment of the body 10.

Figure 4A:
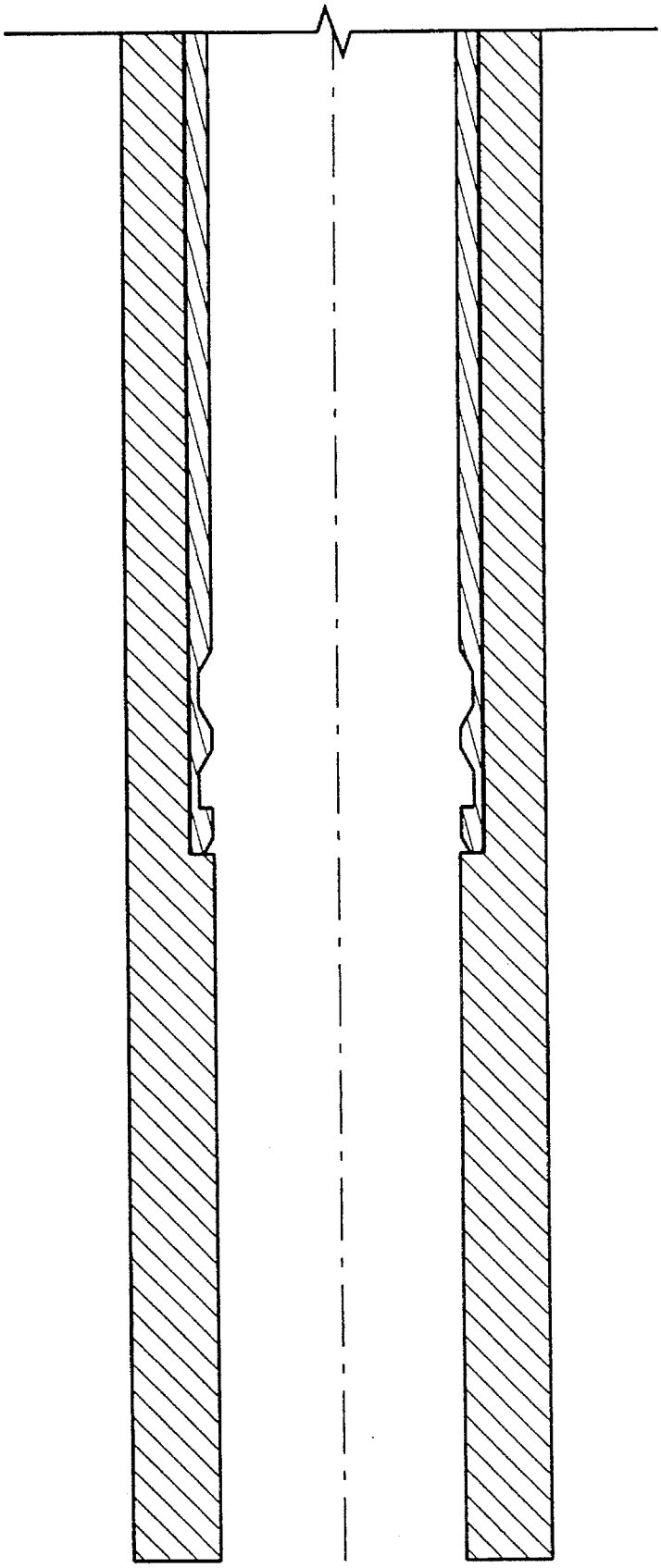
FIGS. 4A–F illustrate the casing of FIGS. 1 and 2, with the sleeve in the open position and the whipstock installed in a position ready for drilling.
Figure 4B:
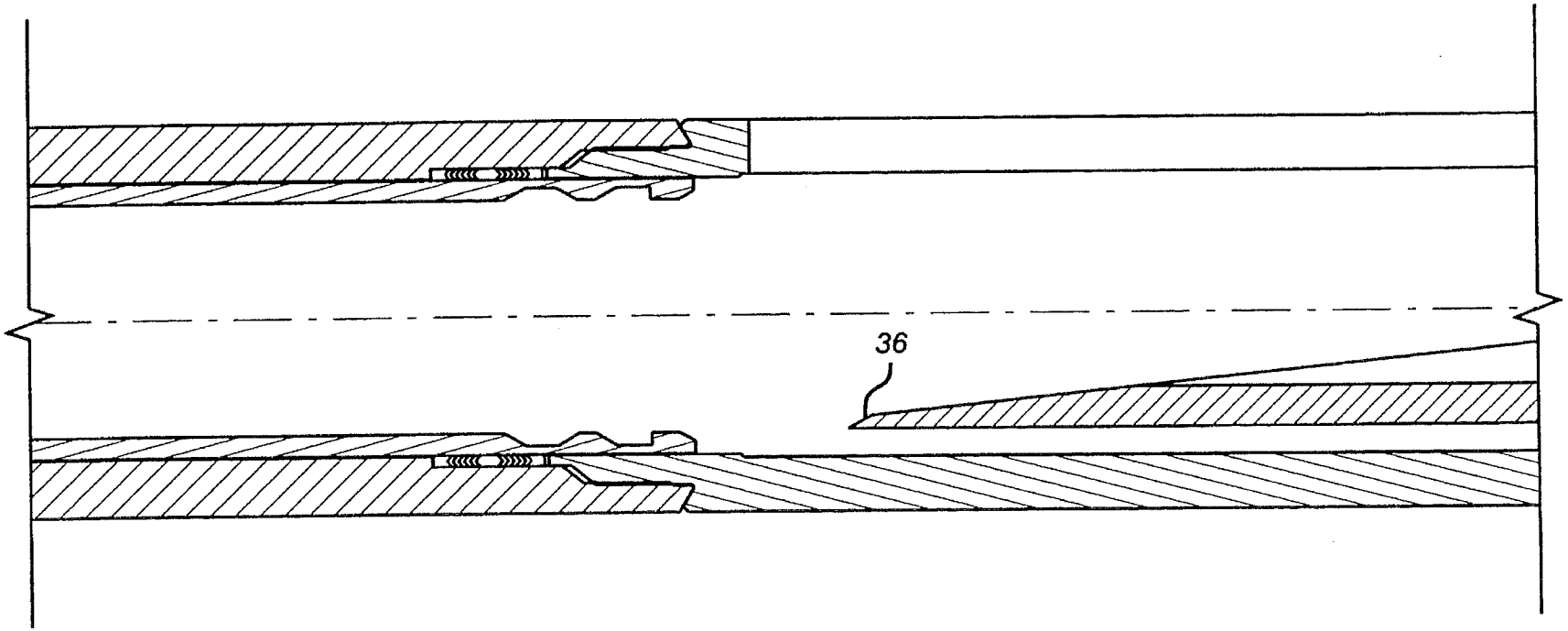
Figure 4C:
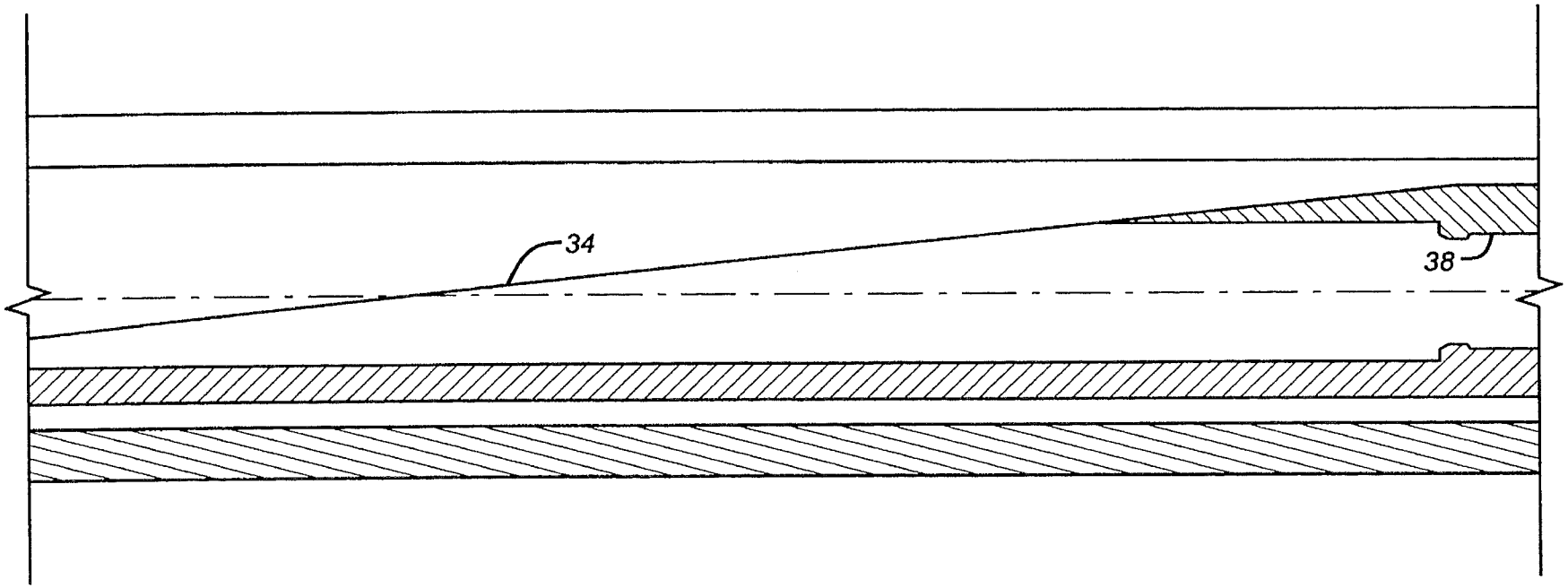
Figure 4D:
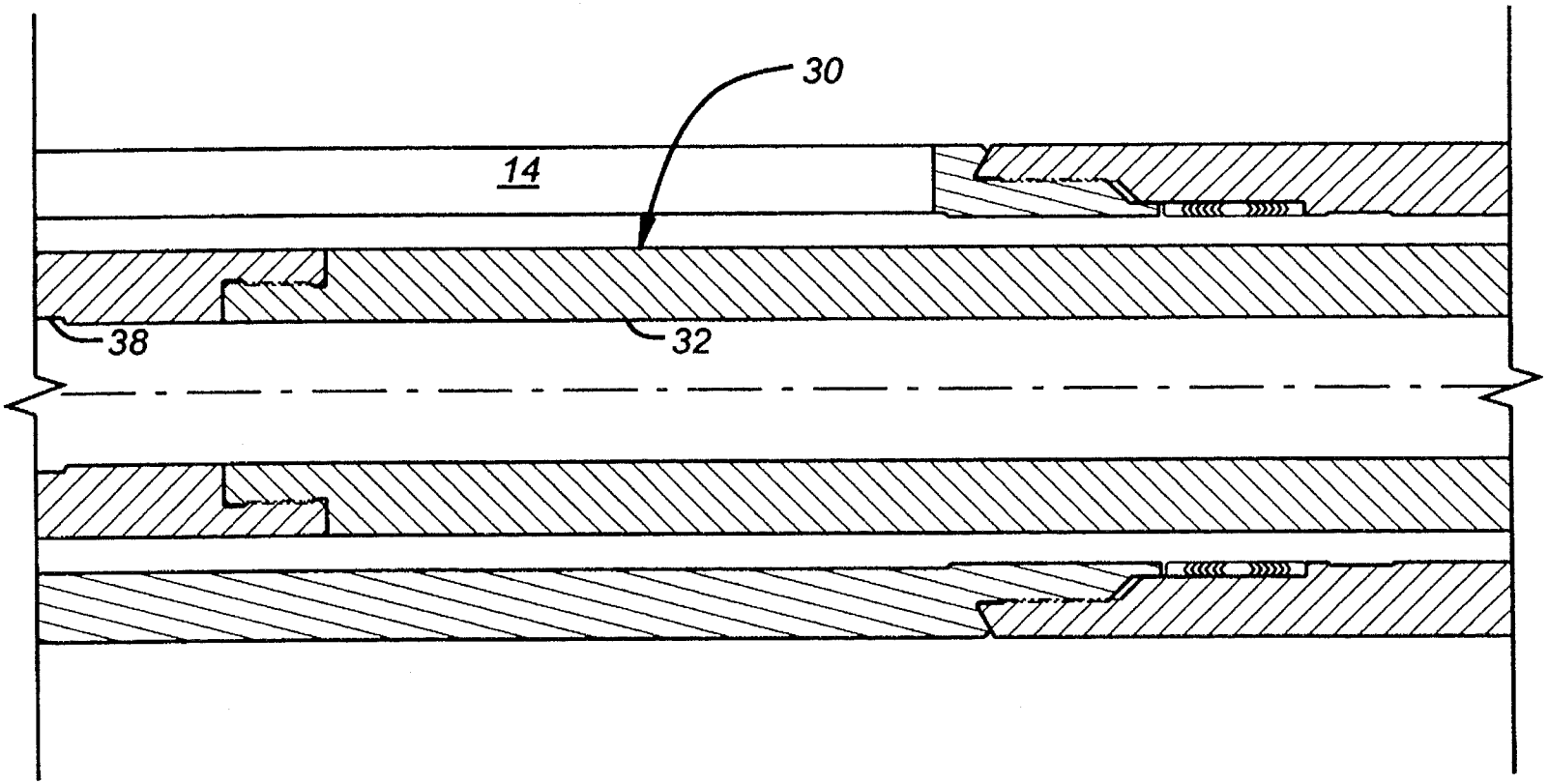

In the preferred embodiment, chevron seals 16 and 18 are, respectively, present at the upper and lower ends of window 14. Housing 20 retains the chevron seals 16 and 18 to the body 10. Sliding sleeve 12 has a groove or grooves 26 near its upper end and a groove or grooves 28 near its lower end for selective engagement with a shifting tool (not shown), of a type well-known in the art. Use of the shifting tool (not shown) can move the sleeve 12 from the position shown in FIG. 1B, wherein the window 14 is closed, to the position shown in FIG. 4B, where the window 14 is open. Those skilled in the art will appreciate that different types of seals other than a stack of opposed chevron seals can be used as the sealing assembly 16 or 18 without departing from the spirit of the invention.

Figure 1A:
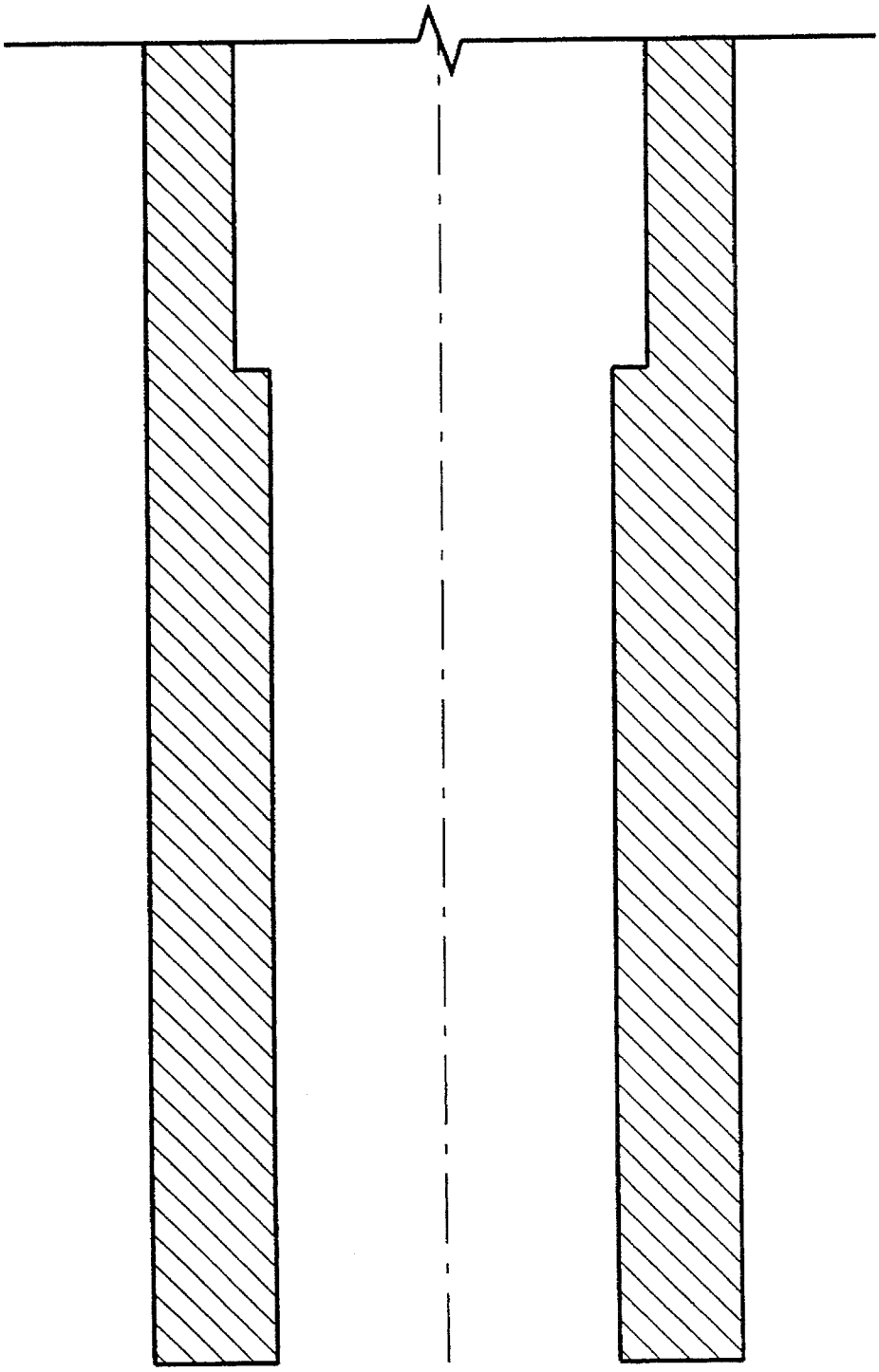
FIGS. 1A–D illustrate the casing segment, showing the window and the sliding sleeve.
Figure 1B:
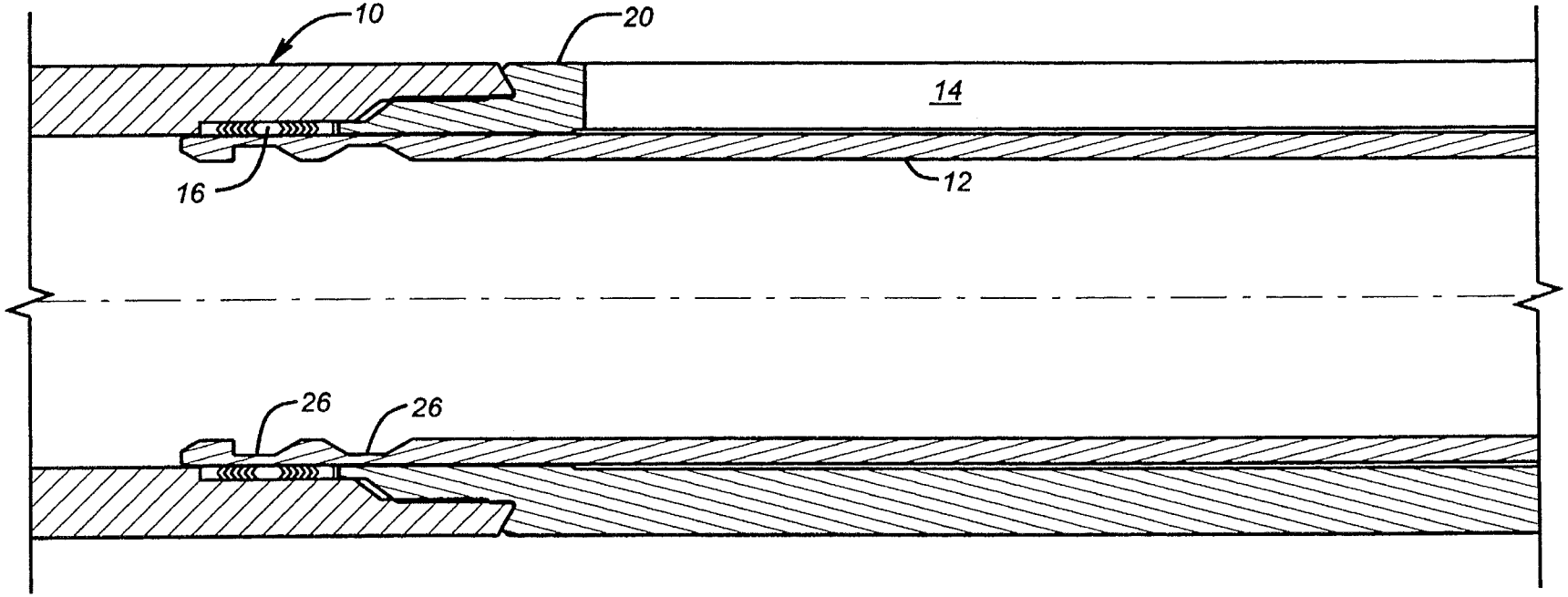
Figure 1C:
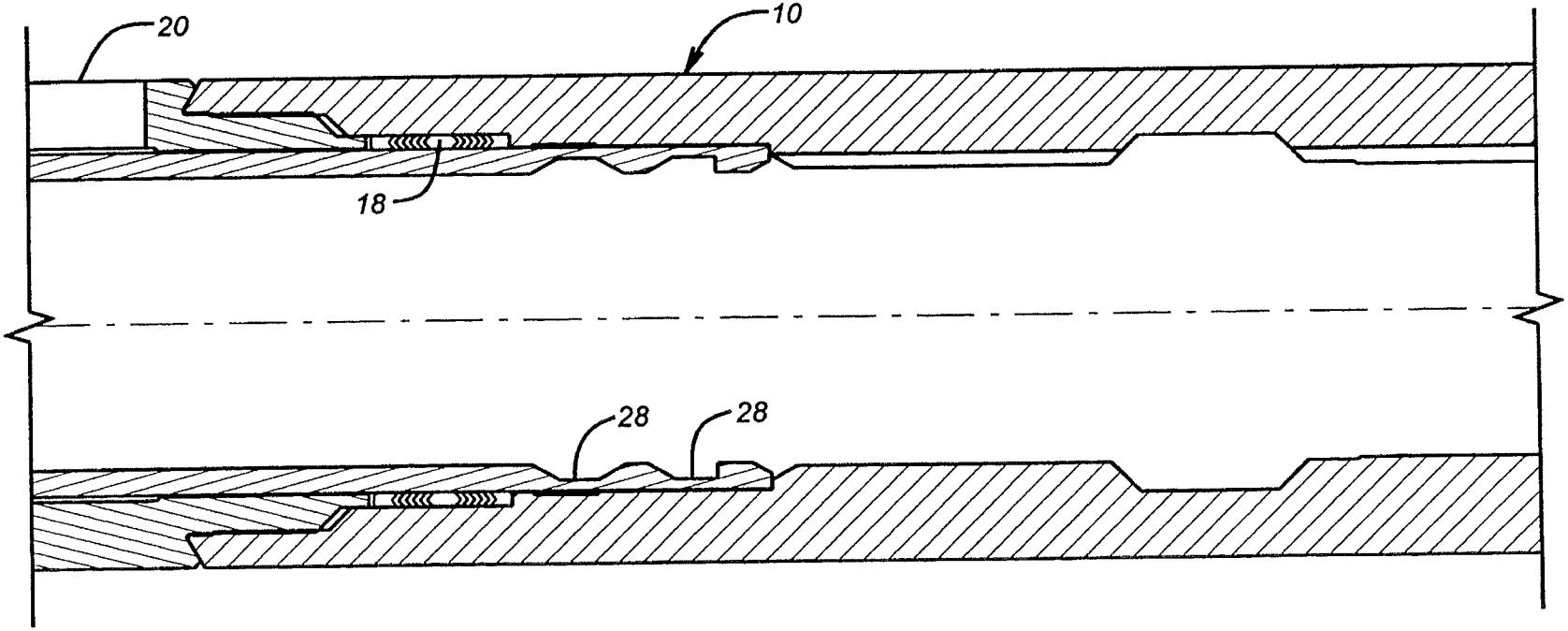
Figure 1D:
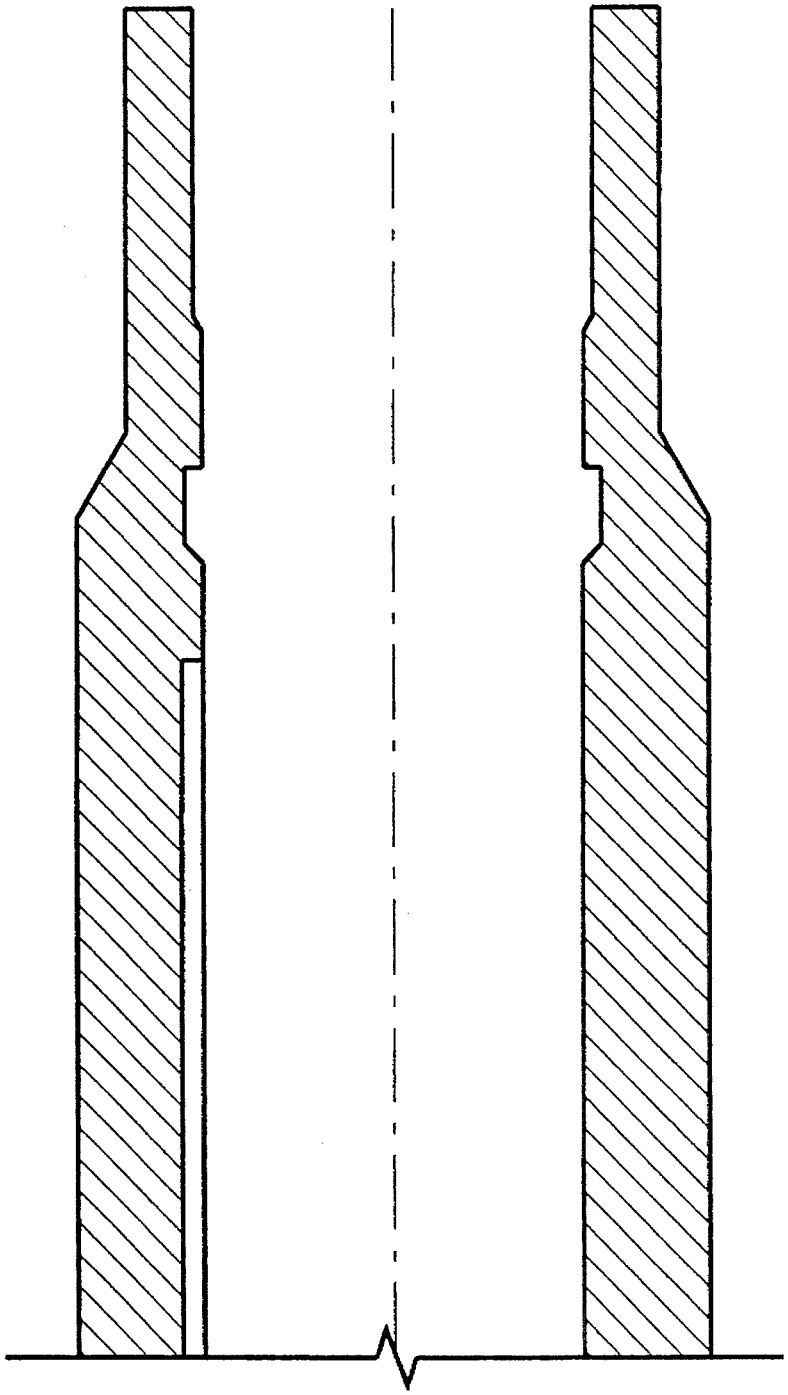
Figure 2A:
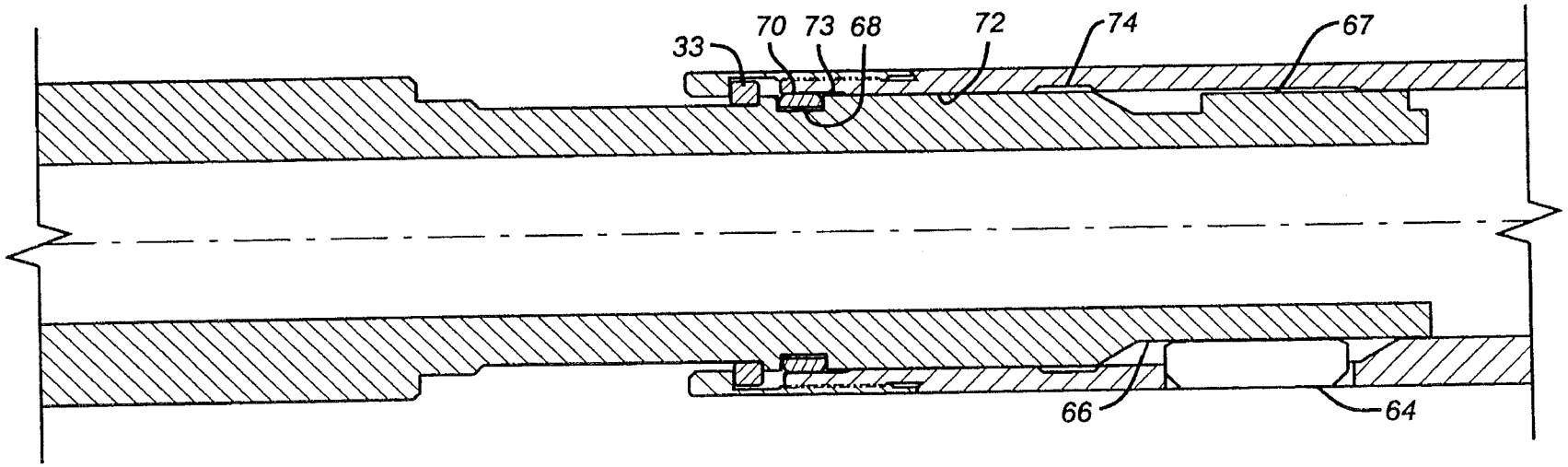
FIGS. 2A–D illustrate the run-in position.
Figure 2B:
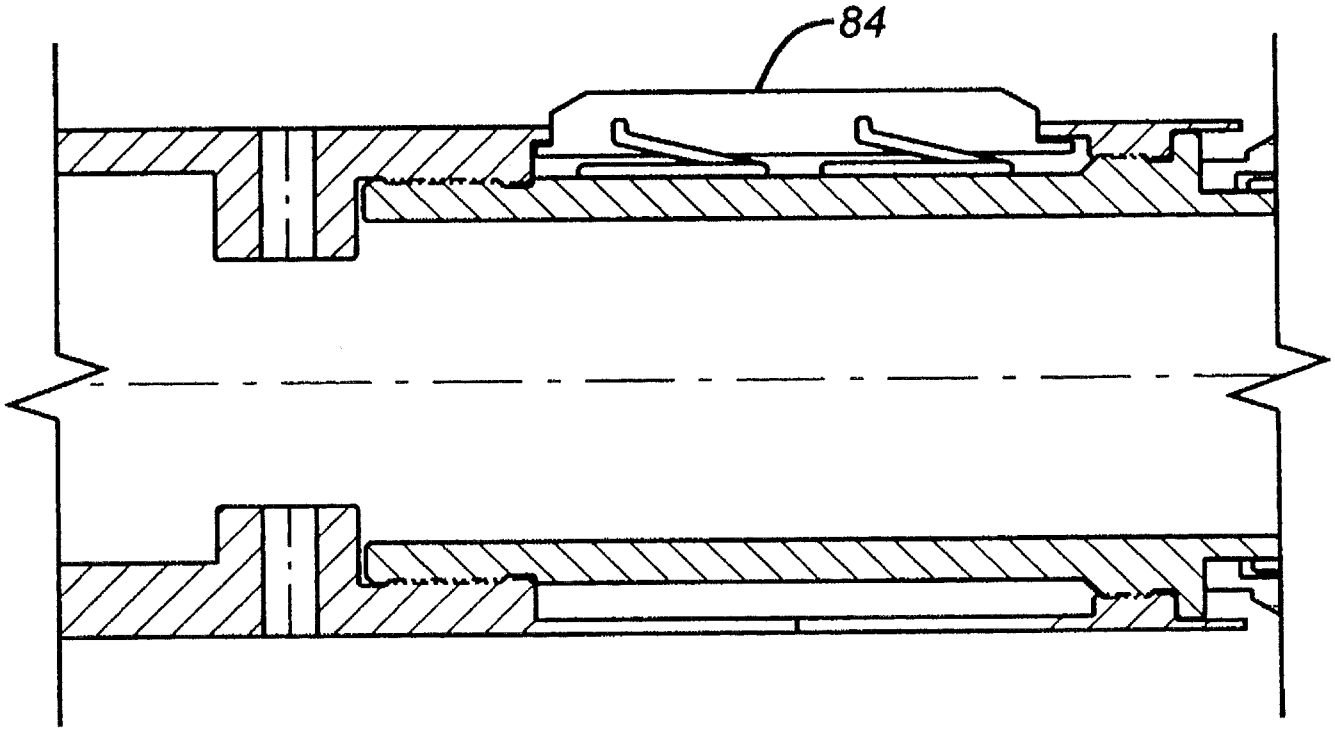
Figure 2C:
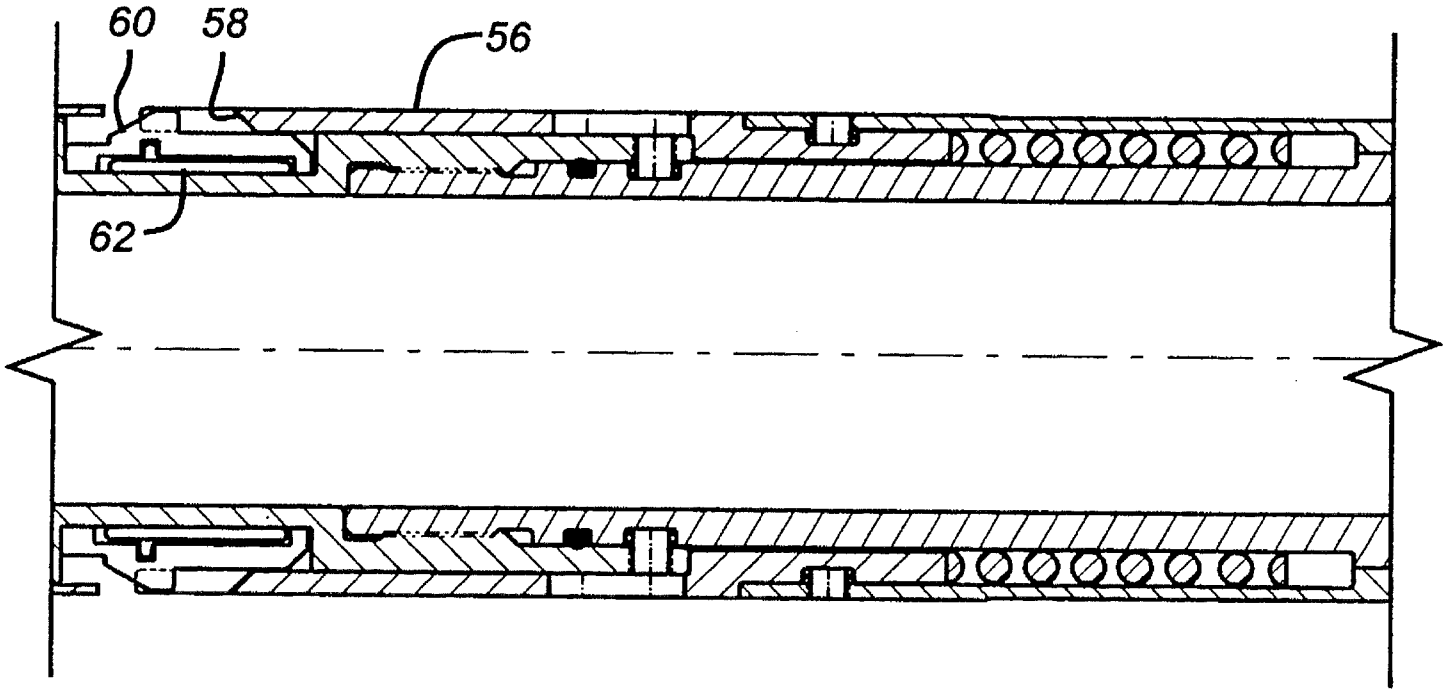
Figure 2D:
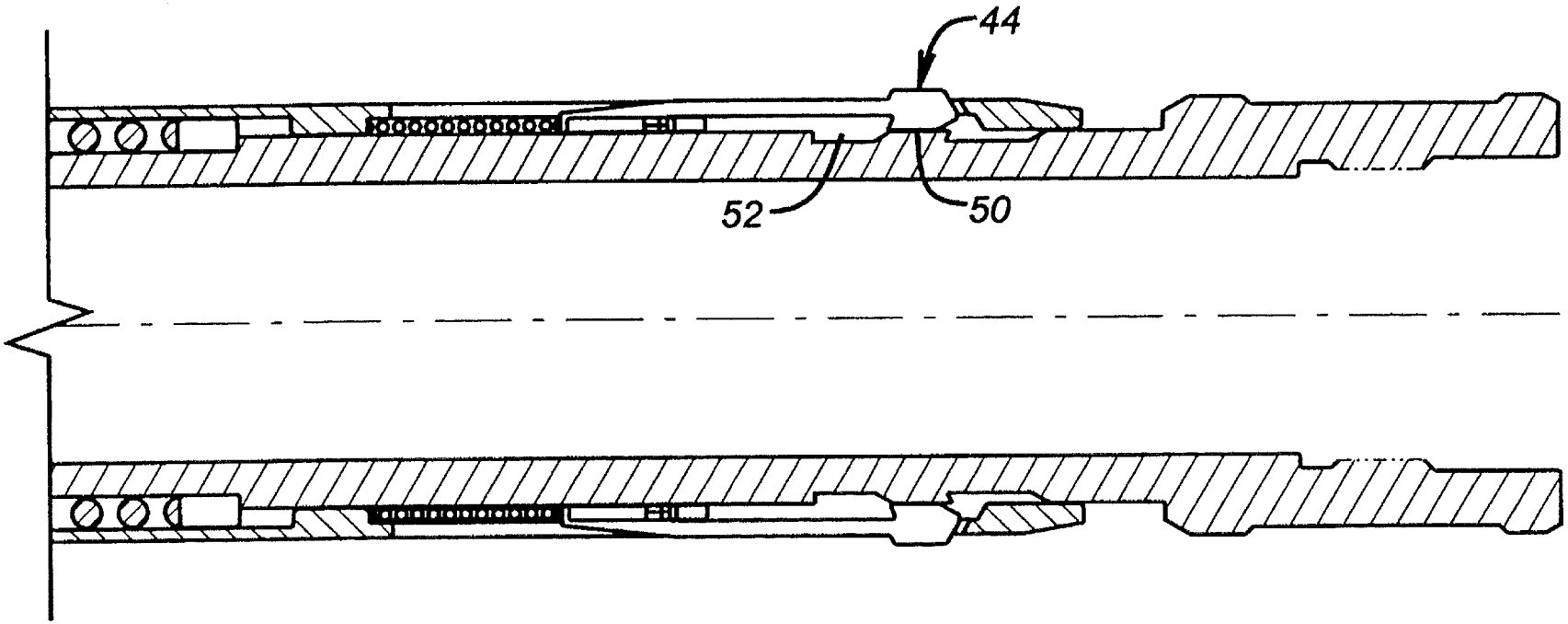
Figure 3:
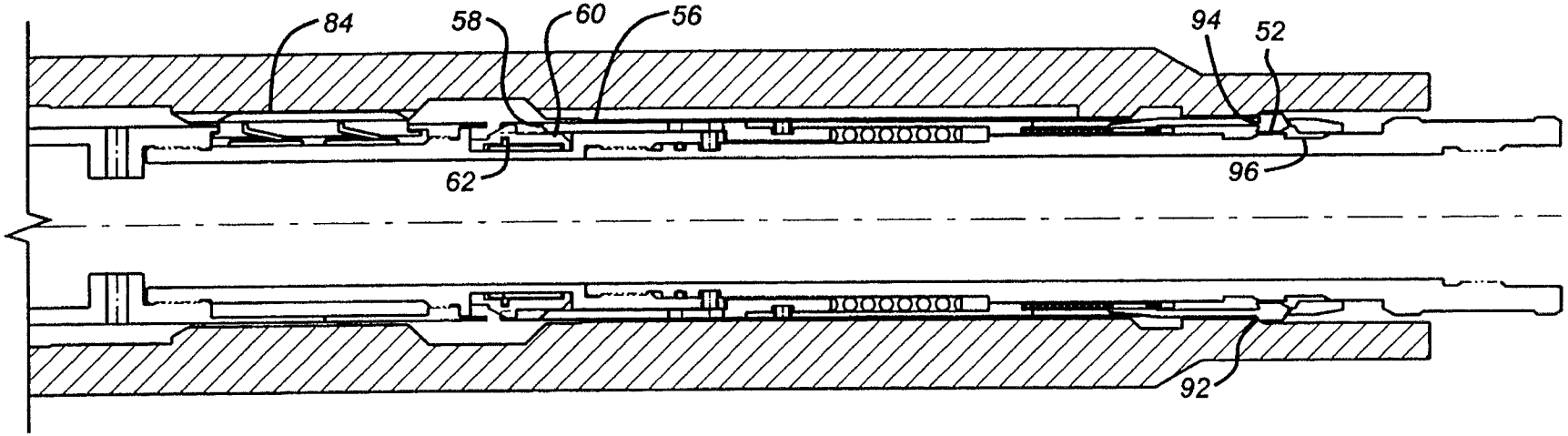
FIG. 3 illustrates the lower end of the casing in section showing the support for the whipstock in the lift-up position.

The whipstock 30 is shown in FIGS. 4A–F in the set position. Whipstock 30 has a central bore 32 which extends to a taper 34 at the upper end 36. Also located in bore 32 is a groove 38, which is useful in attaching the whipstock 30 to a running tool so that it can be positioned in the position shown in FIG. 3 from the surface. Groove 38 may also be used for fishing operations to assist in removal of a stuck whipstock 30 by merely pulling up. In normal operations, whipstock 30 is removed by pulling upon groove 38. Ring 33 can be used to facilitate removal of lower segment 41 with upper segment 39. The whipstock 30 has an upper segment 39 and a lower segment 41. Lug 67 maintains upper segment 39 in a specific orientation to lower segment 41 by a keyway (not shown) so that segments 39 and 41 can translate but not rotate with respect to each other.

Figure 4E:
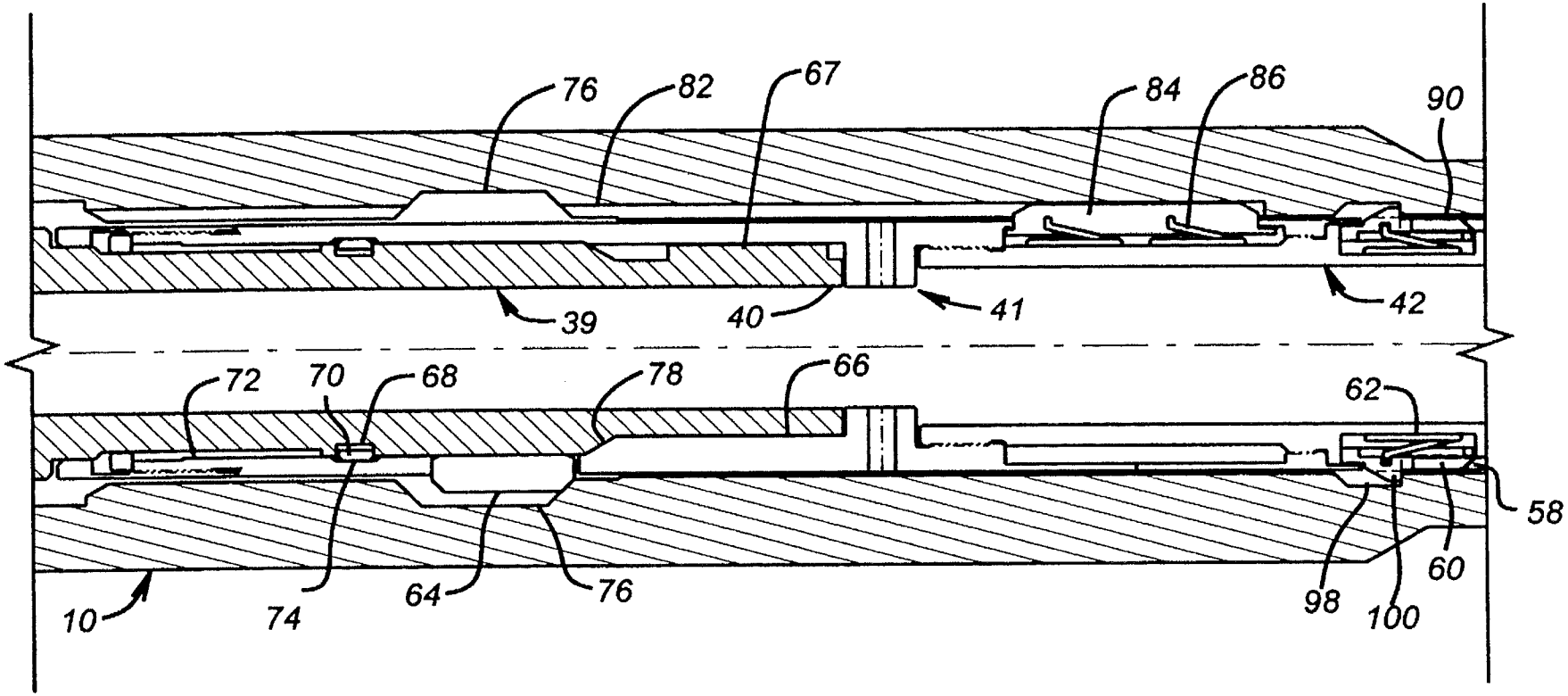
Figure 4F:
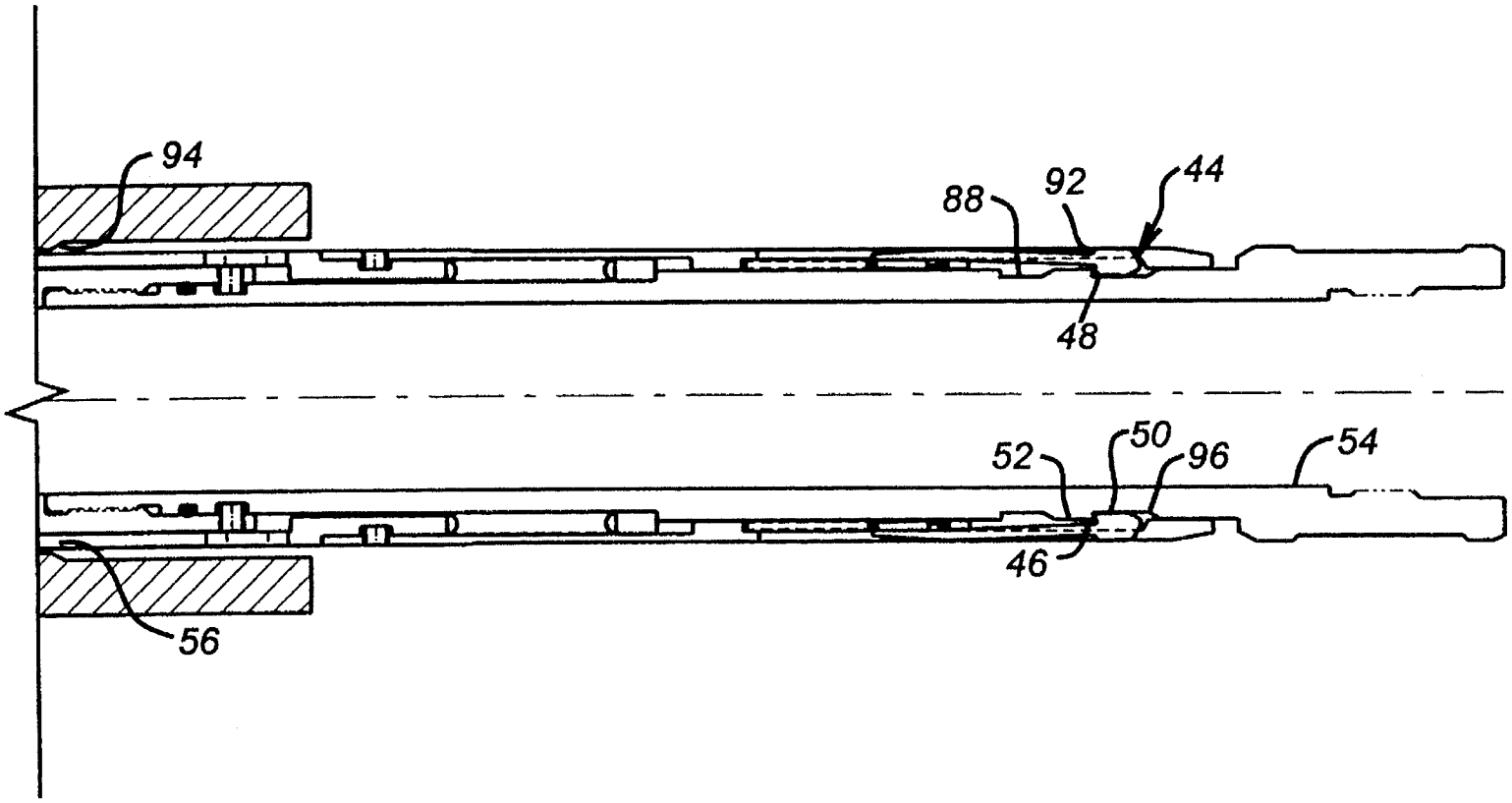

Attached to the lower end 40 of whipstock 30 is a locating apparatus 42. The locating apparatus 42 is shown in the set position in FIG. 4E. In the set position, the collet 44 has a surface 46 which is shown hooked on mating surface 48 on the locating apparatus 42. However, during the run-in position shown in FIG. 2A–D, surface 50 of collet 44 becomes juxtaposed adjacent to surface 52 of mandrel 54 to clear surface 90 (see FIG. 4F). Therefore, during the run-in position, sleeve 56, which has an upper end 58, interferes with dog 60, holding it inwardly against the opposing force of biasing spring 62. At the same time during run-in, dog 64 rides on surface 66 of the whipstock 30. Whipstock 30 has a groove 68 in which sits a split ring 70, which in the run-in position is juxtaposed against groove 73, with groove 74 misaligned with groove 68. Ultimately, when there is latching, as shown in FIG. 4E, grooves 68 and 74 come into alignment to allow split ring 70 to expand and secure the position of locking dog or dogs 64 into a groove 76 on the body 10. The whipstock 30 has a tapered surface 78 adjacent to surface 66 so that in the latching operation, the locking dogs 64 are cammed outwardly along surface 78 into groove 76 to secure the engagement of the whipstock 30 to the body 10 for longitudinal support (see FIG. 4E).

The whipstock 30 has a locating dog 84 which is formed to engage a locating groove 82 for proper alignment of the taper 34 with the window 14 in a manner known in the art. Locating dogs 84 are outwardly biased by springs 86 to secure and orient the whipstock 30 against rotational forces during the drilling operation through the window 14. The locating dogs 84 can be displaced radially inwardly until they come into alignment with their appropriate grooves in the body 10, at which point the springs 86 push the dogs 84 outwardly into their mating grooves. Since the dogs 84 are mounted to the locating apparatus 42 in a manner that they cannot rotate with respect to the locating apparatus 42, outward movement of the locating dogs 84 into their respective grooves effectively provides a rotational lock.

In running in the tool, the assembly of the whipstock 30 with the locating apparatus 42 is run into the body 10 with a suitable running tool. The assembly is run in a first direction to below the position shown in FIGS. 2A–D and then brought up in a second and opposite direction (see FIG. 3). Collet 44 is first temporarily displaced into groove 88 so that it can clear surface 90 as the assembly of the whipstock 30 and locating apparatus 42 is run downwardly in said first direction into body 10. Once the assembly of the whipstock 30 and locating apparatus 42 are brought back up in said second direction, the collets 44 have a surface 92 which engages tapered surface 94 on body 10. This results in movement of the collets 44 downwardly into groove 96 to the position shown in FIG. 4D. Shifting the collets 44 downwardly into groove 96 moves away the upper end 50 from the engagement dogs 60, which allows them to move radially outwardly into groove 98 on body 10.

The dogs 60 have an extending segment 100 which, when latched into groove 98, provides the initial longitudinal support for whipstock 30. Thereafter, when weight is set down on said upper segment 39, it moves in said first direction with respect to lower segment 41 as taper 78 cams locking dogs 64 and split ring 70 enters groove 74. In short, the locating apparatus, in combination with the body 10, provides for proper orientation of the whipstock 30 through the use of locating dogs 84 which fit into a special groove machined into the body 10. Longitudinal support for the whipstock 30 is provided by locking dogs 64. Engagement dogs 60 only temporarily support the whipstock 30 until the locking dogs 64 extend into the body 10. Rotational support for the whipstock 30 is provided by dogs 84 which go into mating depressions 82 in the body 10, thereby acting as keys which lock against torsional forces transmitted by the drilling operation through the window 14 to the whipstock 30.

Those skilled in the art will appreciate that by combining the feature of use of the whipstock 30 along with a body that has a preformed window which can be selectively covered by a sliding sleeve 12, time and money can be saved for the well operator. The reason for this is that in fewer trips into the bore the complete sidetrack can be accomplished. This is an improvement over past techniques where a milling tool is first used to make the opening in the casing. It is then removed and replaced by a drillbit to actually bore the deviated bore. In the present invention, the window is opened with a shifting tool and the whipstock 30 is set with a running tool in one trip. Drilling a deviated wellbore then commences with a drillbit in a second trip. A third trip of using the milling tool can be eliminated.

A new manner of support of the whipstock has also been described which allows proper support against rotation and longitudinal movement and proper orientation, as well as a flow-through feature.

The foregoing disclosure and description of the invention are illustrative and explanatory thereof, and various changes in the size, shape and materials, as well as in the details of the illustrated construction, may be made without departing from the spirit of the invention.

I claim:

1. An apparatus for creating sidetrack in a wellbore extending from a surface location, comprising:

a tubular housing insertable in the wellbore extending adjacent a point where the sidetrack is to commence, said housing further comprising:

a cover selectively movable over an opening formed in said tubular housing between a first position where said opening is covered and a second position where said opening is exposed;

a whipstock supported by said housing, said whipstock having a tapered guiding surface in alignment with said opening whereupon when said cover is selectively placed in said second position, a sidetrack can be drilled through said opening.

2. The apparatus of claim 1, wherein:

said cover is shiftable between said first and second positions from the surface of the wellbore;

said opening is sealingly closed when said cover is in its said first position.

3. The apparatus of claim 2, wherein said housing further comprises:

a shoulder; and said whipstock comprises at least one collet movable past said shoulder in a first direction but engaging said shoulder in a reversed second direction.

4. The apparatus of claim 3, wherein:

said collet is connected to a sleeve;

said whipstock further comprises at least one engagement dog retained against radially outward movement by said sleeve until said collet moves said sleeve to release said dog radially for engagement with said housing.

5. The apparatus of claim 4, further comprising:

an engagement groove on said housing; and said engagement dog shaped to prevent movement of said whipstock in said first direction when extended into said engagement groove.

6. The apparatus of claim 5, further comprising:

at least one locking dog on said whipstock and a matching locking groove on said housing; and said whipstock forcing said locking dog into said locking groove upon application of force to said whipstock in said first direction after said engagement dog is supported by said engagement groove on said housing.

7. The apparatus of claim 6, wherein:

longitudinal support for said whipstock is transferred from said engagement dog to said locking dog as a result of movement of said whipstock in said first direction after said engagement dog is in said engagement groove.

8. The apparatus of claim 7, further comprising:

an orientation groove in said housing;

at least one orientation lug in said whipstock;

whereupon when said lug is advanced into said orientation groove, said tapered guiding surface on said whipstock is oriented toward said opening in said housing.

9. The apparatus of claim 8, wherein:

said orientation lug is outwardly biased; and said orientation lug provides resistance to angular rotation of said whipstock in said housing.

10. The apparatus of claim 9, further comprising:

a top section selectively movable with respect to a bottom section on said whipstock;

said top section comprising a tapered surface for camming said locking dog and said tapered guiding surface; and said top section is keyed to said bottom section to prevent relative rotation therebetween while allowing relative longitudinal movement to allow said tapered surface to cam said locking dogs.

11. The apparatus of claim 10, further comprising:

a temporary indexing mechanism acting on said top and bottom sections to temporarily retain their relative positions in a first position where said locking dog is retracted and a second position where said tapered surface has cammed said locking dog outwardly into said housing.

12. The apparatus of claim 11, wherein said indexing mechanism comprises:

a split ring in a groove in said top section and an upper and lower opposed groove in said bottom section;

whereupon said split ring can selectively expand into one or the other of said opposed grooves to selectively secure said top section to said bottom section in two positions.

13. The apparatus of claim 1, further comprising:

a flowpath through said whipstock to allow production therethrough with said whipstock in place.

14. The apparatus of claim 12, further comprising:

a flowpath through said whipstock to allow production therethrough with said whipstock in place.

15. The apparatus of claim 13, further comprising:

an internal groove in said flowpath to facilitate engagement of said whipstock by a fishing or retrieving tool for removal to the surface.

16. A whipstock mountable in a housing, comprising:

a housing comprising a shoulder;

said whipstock comprises at least one collet movable past said shoulder in a first direction but engaging said shoulder in a reversed second direction;

said collet is connected to a sleeve;

said whipstock further comprises at least one engagement dog retained against radially outward movement by said sleeve until said collet moves said sleeve to release said dog radially for engagement with said housing.

17. The apparatus of claim 16, further comprising:

an engagement groove on said housing; and said engagement dog shaped to prevent movement of said whipstock in said first direction when extended into said engagement groove.

18. The apparatus of claim 17, further comprising:

at least one locking dog on said whipstock and a matching locking groove on said housing; and said whipstock forcing said locking dog into said locking groove upon application of force to said whipstock in said first direction after said engagement dog is supported by said engagement groove on said housing.

19. The apparatus of claim 18, wherein:

longitudinal support for said whipstock is transferred from said engagement dog to said locking dog as a result of movement of said whipstock in said first direction after said engagement dog is in said engagement groove.

20. The apparatus of claim 19, further comprising:

an orientation groove in said housing;

at least one orientation lug in said whipstock;

whereupon when said lug is advanced into said orientation groove, said tapered guiding surface is properly oriented.

21. The apparatus of claim 20, wherein:

said orientation lug is outwardly biased; and said orientation lug provides resistance to angular rotation of said whipstock in said housing.

22. The apparatus of claim 21, further comprising:

a top section selectively movable with respect to a bottom section on said whipstock;

said top section comprising a tapered surface for camming said locking dog and said tapered guiding surface; and said top section is keyed to said bottom section to prevent relative rotation therebetween while allowing relative longitudinal movement to allow said tapered surface to cam said locking dogs.

23. The apparatus of claim 22, further comprising:

a temporary indexing mechanism acting on said top and bottom sections to temporarily retain their relative positions in a first position where said locking dog is retracted and a second position where said tapered surface has cammed said locking dog outwardly into said housing.

24. The apparatus of claim 23, wherein said indexing mechanism comprises:

a split ring in a groove in said top section and an upper and lower opposed groove in said bottom section;

whereupon said split ring can selectively expand into one or the other of said opposed grooves to selectively secure said top section to said bottom section in two positions.

25. The apparatus of claim 16, further comprising:

a flowpath through said whipstock to allow production therethrough with said whipstock in place.

26. The apparatus of claim 23, further comprising:

a flowpath through said whipstock to allow production therethrough with said whipstock in place.

* * * * *